US010648124B2

(12) United States Patent
Khamprachom et al.

(10) Patent No.: US 10,648,124 B2
(45) Date of Patent: May 12, 2020

(54) LID FOR WASHING MACHINE

(71) Applicant: Electrolux Thailand Co., Ltd., Huay Kwang, Bangkok (TH)

(72) Inventors: Chatchawan Khamprachom, Stockholm (SE); Pankaj Jadhav, Stockholm (SE); Worawoot Kongpisootpaisahn, Stockholm (SE); Suttipong Thongklom, Stockholm (SE)

(73) Assignee: Electrolux Thailand Co., Ltd., Bangkok (TH)

( * ) Notice: Subject to any disclaimer, the term of this patent is extended or adjusted under 35 U.S.C. 154(b) by 0 days.

(21) Appl. No.: 15/374,269

(22) Filed: Dec. 9, 2016

(65) Prior Publication Data

US 2017/0167071 A1 Jun. 15, 2017

(30) Foreign Application Priority Data

Dec. 11, 2015 (AU) ..... 2015268670

(51) Int. Cl.
*D06F 39/14* (2006.01)
*E06B 3/72* (2006.01)

(52) U.S. Cl.
CPC ..... *D06F 39/14* (2013.01); *E06B 3/721* (2013.01)

(58) Field of Classification Search
CPC ..... D06F 37/18; D06F 37/26; D06F 37/28; D06F 39/12; D06F 39/14
See application file for complete search history.

(56) References Cited

U.S. PATENT DOCUMENTS 4,466,206 A * 8/1984 Meadows ..... A47G 1/06 248/489
4,522,311 A 6/1985 Ikeda
4,853,055 A * 8/1989 Taylor ..... B60J 10/70 156/108
2004/0020246 A1 2/2004 Yun et al.
2004/0164657 A1 8/2004 Park et al.
2006/0059956 A1 3/2006 Zardetto
2006/0090523 A1* 5/2006 Lyu ..... D06F 37/28 68/3 R (Continued)

FOREIGN PATENT DOCUMENTS

WO 2014120739 A1 8/2014

OTHER PUBLICATIONS

Non Final Office Action for U.S. Appl. No. 15/374,155, dated Apr. 2, 2018, 9 pages.

(Continued)

*Primary Examiner* — David G Cormier
(74) *Attorney, Agent, or Firm* — RatnerPrestia

(57) ABSTRACT

A lid assembly (10) for a washing machine having a frame (2, 3) and top section (1) made of a glass material attached to the frame. The lid assembly has at least one elastic member provided between the underside of the top section and the upper side of the frame in a central area of the top section. The lid assembly reduces the risk for damaging the glass top section, such that there will be a reduced risk of breaking the glass if the lid suffers from a heavy impact. Also there is a reduced risk of scratching the glass material from underneath since the glass top section is cushioned against the supporting frame underneath at a central area of the glass top section.

8 Claims, 2 Drawing Sheets

(56) References Cited

U.S. PATENT DOCUMENTS

2007/0125132 A1 6/2007 Hwang

OTHER PUBLICATIONS

Final Office Action for U.S. Appl. No. 15/374,155, dated Oct. 30, 2018, 16 pages.
Non Final Office Action for U.S. Appl. No. 15/374,155, dated Feb. 7, 2019, 11 pages.
Final Office Action for U.S. Appl. No. 15/374,155, dated Jun. 26, 2019, 11 pages.

* cited by examiner

LID FOR WASHING MACHINE

CROSS-REFERENCE TO RELATED APPLICATION

The present application claims priority to Australian Application 2015268670 filed Dec. 11, 2015 which application is hereby incorporated by reference in its entirety.

TECHNICAL FIELD

The present disclosure relates to a washing machine. In particular the present disclosure relates to a lid for a washing machine where the lid is at least partly formed by a transparent material such as glass.

BACKGROUND

Washing machines are provided with lids. The lids can have a transparent section. For top loaded washing machines the lid can be formed, at least partly by a glass material. For example WO2014/120739 describes a lid for a washing machine with glass.

There is a constant desire to improve the design of a washing machine. Hence, there is a need for a washing machine having an improved lid.

SUMMARY

It is an object of the present invention to provide an improved washing machine. It is a particular object of the present invention to provide an improved washing machine with a lid provided with a glass material.

In accordance with one embodiment a lid assembly for a washing machine is provided. The lid assembly comprises a frame and top section made of a glass material attached to the frame. The lid assembly has at least one elastic member provided between the underside of the top section and the upper side of the frame in a central area of the top section. Hereby it is achieved that the risk for damaging the glass top section is reduced, such that there will be a reduced risk of breaking the glass if the lid suffers from a heavy impact. Also there is a reduced risk of scratching the glass material from underneath since the glass top section is cushioned against the supporting frame underneath at a central area of the glass top section.

In accordance with one embodiment at least one elastic member is located in the range of 5-30 cm from the periphery of the top section. For example the at least one elastic member can be located at least 10 cm from the periphery of the top section. Hereby it is ascertained that the elastic member cushions the glass top section at a correct location.

In accordance with one embodiment the lid assembly further comprises an elastic material provided between the underside of the top section and the upper side of the frame at the periphery of the top section.

In accordance with one embodiment at least two elastic members 6 are provided in said central area.

In accordance with one embodiment the at least one elastic member is formed by an elastomer pad or a rubber pad.

The invention also extends to a washing machine lid and to a washer machine.

BRIEF DESCRIPTION OF THE DRAWING

The present invention will now be described in more detail by way of non-limiting examples and with reference to the accompanying drawing, in which.

DETAILED DESCRIPTION

Figure 1:
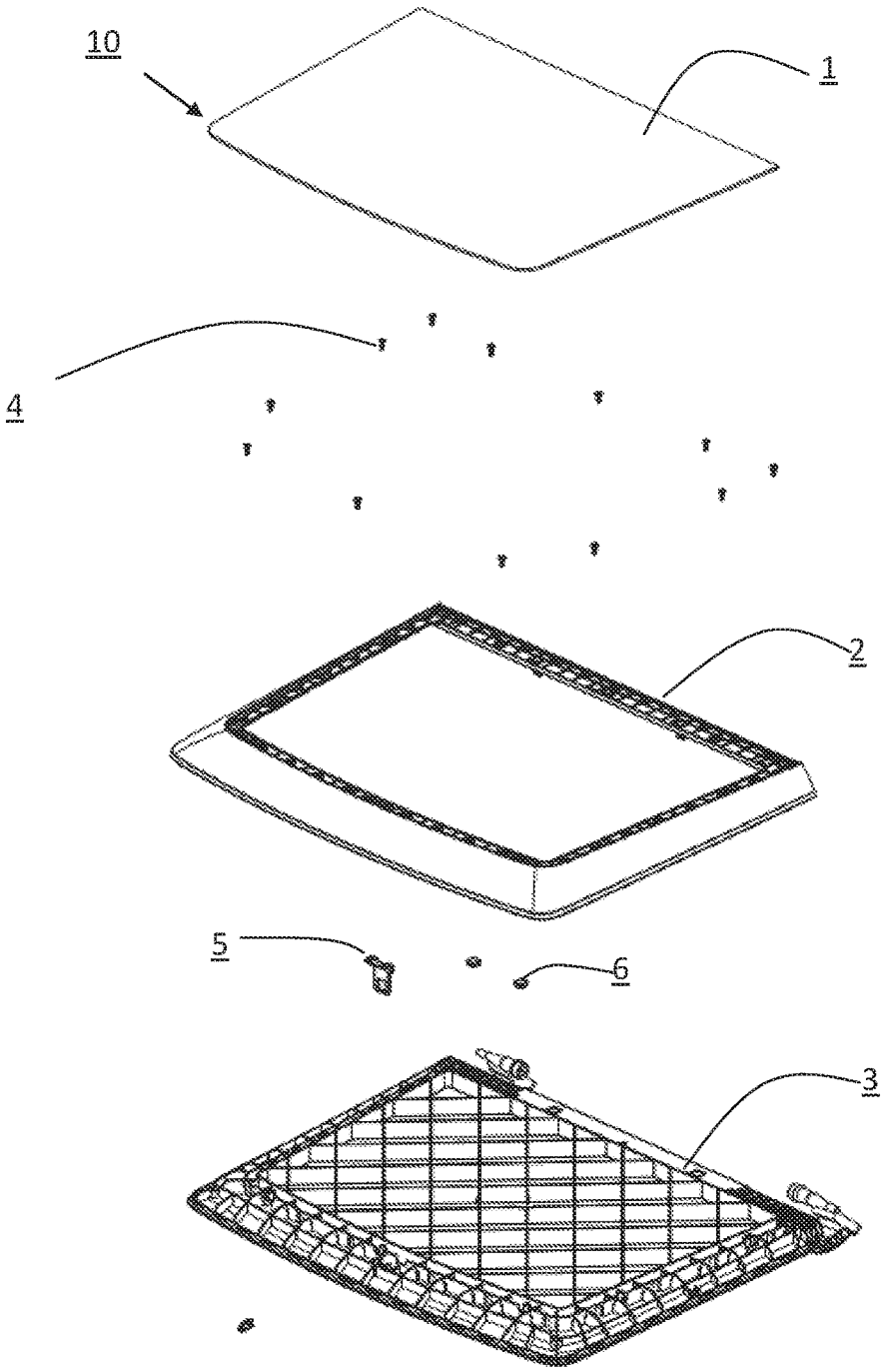
FIG. 1 is an exploded view of a lid assembly for a washing machine.

In the following a lid assembly for a washing machine will be described. In the figures, like reference numerals designate identical or corresponding elements throughout the several figures. It will be appreciated that these figures are for illustration only and are not in any way restricting the scope of the invention. Also it is possible to combine features from different described embodiments to meet specific implementation needs.

In FIG. 1 an exploded view of a lid assembly 10 for a washing machine is shown. The lid assembly 10 comprises a top section 1 formed by a glass material. The top section 1 is secured to a lid frame. The top section 1 can in accordance with some embodiments be secured to a frame formed by a lid frame bottom 3 attached to a lid frame top 2. The lid frame top 2 can for example be snap fit onto the lid frame bottom 3. Alternatively or in addition to the snap fit connection, the lid frame top 2 can be screwed onto the lid frame bottom 3 using screws 4. In addition the lid assembly 10 may or may not comprise a door hook 5.

The top section 1 can be secured to the frame, in this embodiment formed by the lid frame top 2 and lid frame bottom 3, by glue or some adhesive. In this exemplary embodiment the glass top section is attached to the lid frame top, see also FIG. 2. In accordance with another embodiment the lid frame is formed by one integrated assembly onto which the top section 1 is fixed for example using glue of adhesive.

In order to reduce the risk of breaking the top section 1 formed by glass when using the washing machine onto which the lid assembly 10 can be mounted, elastic members 6 or at least one elastic member 6 can be located under the top section 1. In particular the elastic members 6 can be located in a central area well inside the periphery of the top section 1. For example the elastic members 6 can be located in the range of 5-30 cm from the periphery of the top section 1. In particular an elastic member can be located at least 10 cm from the periphery of the top section 1. In accordance with one embodiment a number of elastic members 6 are provided. In particular at least two elastic members 6 are provided. The elastic member(s) 6 can be formed by an elastomer pads or rubber pads. In an alternative embodiment the elastic member(s) are formed by an elastomer sheet or a rubber sheet.

In accordance with one embodiment the elastic member(s) 6 supplement an elastic material located at the periphery under the top section 1. Hence, in such an embodiment the top section will be supported by an elastic material both at its periphery and in a central area when resting on a lid frame.

By providing elastic member(s) 6 under the central area of the top section 1 made by glass a number of advantages can be achieved. For example, the risk of breaking the glass will be reduced since the glass top section 1 is supported not only at the periphery of the glass top section 1 by an elastic material provided under the periphery of the glass top section 1, but also under the central area of the glass top section 1. Because the risk of breaking the glass is reduced, the thickness of the glass top section can be reduced, which in turn reduces the weight of the lid assembly 10 and thereby makes it easier to handle the lid of the washing machine.

Also, there is a reduced risk of scratching the glass top section from underneath should the lid be handled carelessly and a heavy impact is forced onto the glass top section.

Figure 2:
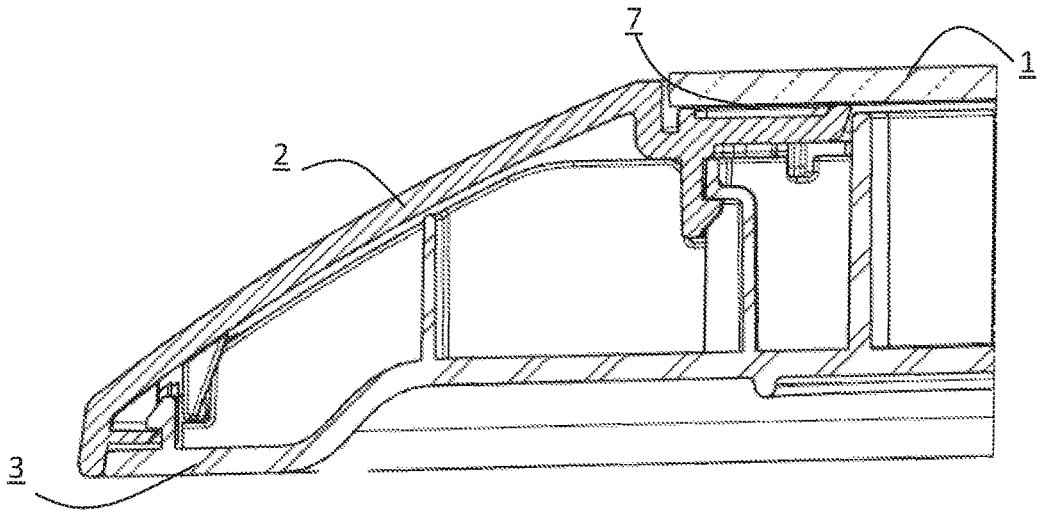
FIG. 2 is a sectional view from the side illustrating fixation between different parts of the lid assembly.
Figure 2:
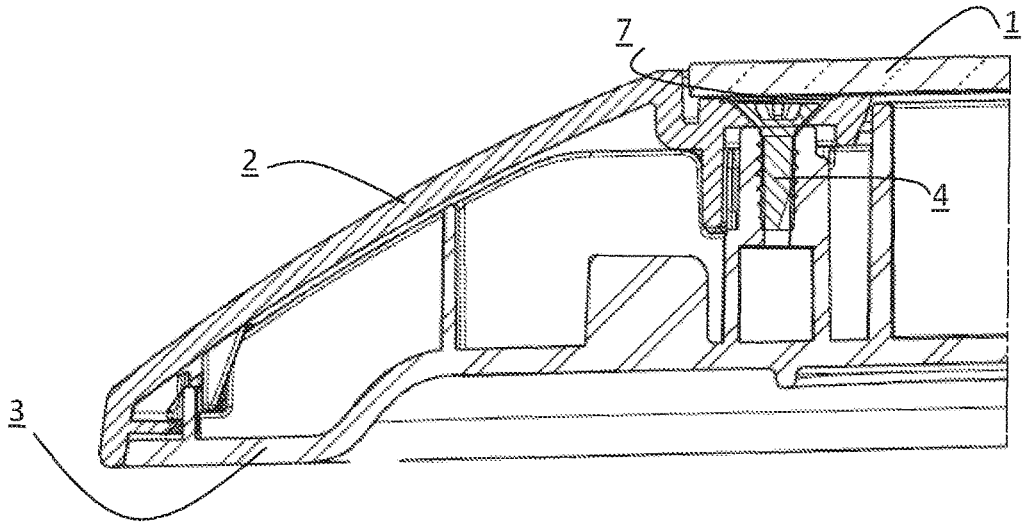

In FIG. 2 a partial sectional view from the side of an assembled lid assembly 10 is shown. Two different embodiments are shown in FIG. 2. An assembly 10 where the top frame 2 is fixed to the bottom frame 3 with screws 5 is shown in the bottom view. An assembly 10 where the top frame 2 is fixed to the bottom frame 3 with snap fit is shown in the top view. The top section 1 is attached with glue or adhesive at 7.

The washing machine having a lid assembly as described herein makes it possible to produce a lid which has a thinner glass top and which at the same time is more robust and is less likely to be scratched by the glass wearing against the underlying support frame. The elastic members supporting the glass in the central area can act to absorb an impact load that is applied to the glass by providing cushioning effect in the central area of the glass top section.

The invention claimed is:

1. A lid assembly for a washing machine, the lid assembly comprising:

a frame comprising a bottom frame connected to a top frame, wherein the top frame includes an upper side portion surrounding an opening of the top frame, and a recessed portion extending from the upper side portion and adjacent the opening;

a top section made of a glass material, the top section having a single continuous outer peripheral edge attached to the top frame in the recessed portion and adjacent the upper side portion, and a central area located inwards of the single continuous outer peripheral edge and in an area corresponding to the upper side portion of the top frame; and at least one elastic member provided in the opening of the top frame between an underside of the top section and an upper side portion of the bottom frame and spaced from the single continuous outer peripheral edge of the top section.

2. The lid assembly according to claim 1, wherein said at least one elastic member is located in the range of 5 -30 cm from the single continuous outer peripheral edge of the top section.

3. The lid assembly according to claim 1, wherein said at least one elastic member is located at least 10 cm from the single continuous outer peripheral edge of the top section.

4. The lid assembly according to claim 1, further comprising an elastic material provided between the underside of the top section and the upper side portion of the frame at the single continuous outer peripheral edge of the top section.

5. The lid assembly according to claim 1, wherein at least two elastic members are provided in said central area.

6. The lid assembly according to claim 1, wherein said at least one elastic member is formed by an elastomer pad or a rubber pad.

7. A washing machine lid comprising the lid assembly according to claim 1.

8. A washing machine comprising the washing machine lid according to claim 7.

* * * * *